United States Patent [19]

Kuhnert

[11] 4,333,320

[45] Jun. 8, 1982

[54] LEFT-LEFT FLAT KNITTING MACHINE

[75] Inventor: Gottfried Kuhnert, Aalen, Fed. Rep. of Germany

[73] Assignee: Universal-Maschinenfabrik Dr. Rudolf Schieber GmbH & Co. KG, Westhausen, Fed. Rep. of Germany

[21] Appl. No.: 102,518

[22] Filed: Dec. 11, 1979

[30] Foreign Application Priority Data

Dec. 13, 1978 [DE] Fed. Rep. of Germany ..... 2853819
Mar. 9, 1979 [DE] Fed. Rep. of Germany ..... 2909339

[51] Int. Cl.[3] ..... D04B 7/06
[52] U.S. Cl. ..... 66/63
[58] Field of Search ..... 66/63, 64, 66, 73, 72, 66/60

[56] References Cited

FOREIGN PATENT DOCUMENTS 936649 12/1955 Fed. Rep. of Germany ..... 60/63
866734 8/1941 France ..... 60/63

*Primary Examiner*—Ronald Feldbaum
*Attorney, Agent, or Firm*—Sughrue, Mion, Zinn, Macpeak and Seas

[57] ABSTRACT

A left-left flat knitting machine is comprised of two needle beds and knitting needle sets arranged in a common plane, with needle hooks provided on both ends of the needles and with bars to activate the knitting needles in the needle bed channels of both needle beds. The knitting needles are formed as double hook needles 1 with two needle humps 10, 11 and the bars are formed as push bars 2, 5 composed of respective stitch transfer bars 3, 6 and tongue bars 4, 7 with integral feet. The structure assures simpler construction of the knitting needles and the tools which activate them and also enables the use of any desired knitting steps for the pattern. According to a further development of the double hook needle 1, a short control tongue 60, 61 is hingedly connected at each needle hump 10, 11.

11 Claims, 19 Drawing Figures

V
V
56
5
55
IV
IV
54
6
7
9
11
1
13
III
III
10
52
16
II
II
8
58
4
3
2
50
16
8
52(16)
51
10
54
6
7
53
56
57

LEFT-LEFT FLAT KNITTING MACHINE

BACKGROUND OF THE INVENTION

The invention relates to a left-left flat knitting machine having two needle beds arranged in a common plane and knitting needles provided with needle hooks at both ends of the needles, which are activated by bars in needle bed channels of both needle beds.

In known left-left flat knitting machines, double head tongue needles, i.e. double hook needles each having a tongue, are provided as the knitting needles. The needles are activated by stitch transfer bars and knitting bars, the latter of which engage in the needle heads and push and pull the needles during operation of the two needle beds in the flat knitting machine.

With the aid of this type of double head tongue needle and the associated tools, customarily hand-knitted stitch loop fabrics can be produced automatically. Although there are a large number of such machines, not every operation of the needles can be achieved with this type of flat knitting machine. It is, for example, not possible for the needles to travel from one needle bed to the other and there form catch loops, because the stitches form the newly added thread into new stitches over the closing tongues.

Furthermore, the needle tongues must be controlled by special tools. The cooperation of these tools with the needle tongues must be so exact that the tools must be adapted to each other with extreme precision. Despite this, however, it does occur that needle bed combs and needle tongues are damaged. For this reason the needle bed combs are also formed as separate knock-over combs which are set into the needle bed. The manufacturing expense therefor is substantially greater than that of solid combs.

SUMMARY OF THE INVENTION

The basic objective of the invention is to create a left-left flat knitting machine of the above-described type, which makes possible a simpler structure of the knitting needles and their activating tools and also enables the use of any desired knitting steps for the pattern.

This objective is achieved according to the invention in that the knitting needles are formed as double hook needles having two needle humps, and in that the bars are formed as push bars composed of a stitch transfer bar and a tongue plate with integral feet.

Forming the knitting needles as double hook needles does away with the tongues at each end of the hooks. With the double hook needle according to the invention it is possible to shift the needle from one needle bed to the other without knitting. This is not possible with the known double head tongue needles without additional means and additional movement. The tools for the activation of the needles are push bars consisting of a stitch transfer bar, which also serves as a thrust bar for the needles, and of a tongue bar.

In order to be able to perform any desired knitting step for the pattern, a short control tongue is hingedly connected to each hump of each double hook needle. Advantageously, a tip of the associated tongue bar can pass under the control tongue when said control tongue is pivoted into its position toward the needle hook, while in the position pivoted toward the center of the needle the control tongue lies flush with the crown of the associated needle hump and is covered by the associated tongue bar.

With this embodiment of the double hook needle, if the tongue bar does not close the head, the old stitch can form a loop with the newly placed thread above the control tongue or can slide into the other needle hook without any newly placed thread. If no stitches are hanging in the needle hooks the control tongues are opened by tongue bars.

Alternatively, the tongue bars can be advantageously formed with a point, the tip of which can be fully received in a recess in the associated needle hump of the double hook needle. This makes it possible for a stitch located on the double hook needle to slide unhindered onto the tongue bar which closes the corresponding needle hook.

The tongue bar is effectively guided in a slit-like channel in the stitch transfer bar. Furthermore, the stitch transfer bar and the tongue bar are advantageously connected in a sliding relationship with each other by means of a rivet in the stitch transfer bar and a long hole in the tongue bar. This construction assures a stable structure of the two-part push bar.

Recesses are advantageously provided in the needle hooks of the double hook needles in which the tongue bars can be guided. This results in a particularly stable guiding of the slidable tongue bars.

Furthermore, the push bars are advantageously formed so that the tongue bars slidably lie on a projection at the tip of the stitch transfer bar. This measure also serves to increase the reliability of the guiding of the tongue bar in the stitch transfer bar.

Relative to its longitudinal portion, the foot of the tongue bar is widened to the width of the stitch transfer bar, so that it has the same width as the foot of the stitch transfer bar. This makes both feet equally stable and equally capable of being acted upon by the associated cam elements in the cam assembly.

DETAILED DESCRIPTION OF THE PREFERRED EMBODIMENTS

Figures 1, 2, 3, 4, 5:
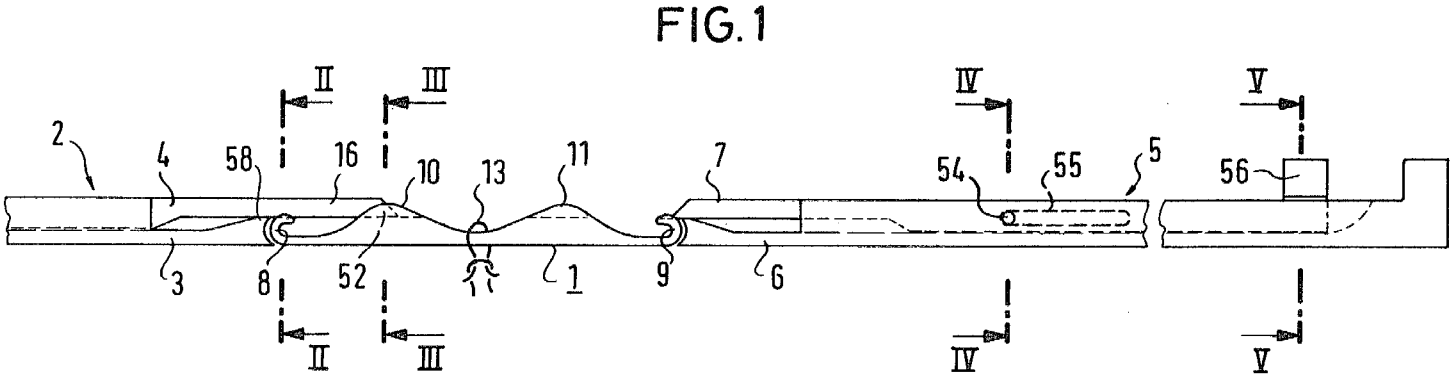
FIG. 1 is a side view of a double hook needle together with push bars with closed and open needle hooks.
FIG. 2 is a cross section through a tongue bar and a needle along the line II—II in FIG. 1.
FIG. 3 is a cross section through the tongue bar and needle along the line III—III in FIG. 1.
FIG. 4 is a cross section through the tongue bar and stitch transfer bar along the line IV—IV in FIG. 1.
FIG. 5 is a cross section through the tongue bar and stitch transfer bar along the line V—V in FIG. 1.

FIG. 1 illustrates a first exemplary embodiment of a double hook needle 1, the left side of which is in contact with a push bar 2 which is slidable in a forward needle bed (not shown) of a left-left flat knitting machine and is also in contact with a push bar 5 which is slidable in the rear needle bed (not shown) of the machine. This double hook needle 1 is pushed back and forth between the two needle beds by these push bars 2 and 5. The double hook needle 1 is formed symmetrically with a left needle hook 8 and a right needle hook 9 as well as with a left needle hump 10 and a right needle hump 11. The push bars 2 and 5 have identical structure.

The push bars 2 and 5 are formed of a stitch transfer bar 3 or 6 and a tongue bar 4 or 7 which is slidable in the stitch transfer bar 3 or 6. A slit-like channel 53 in the stitch transfer bar 6 in the right slide bar 5 receives the tongue bar 7.

Also shown in FIG. 1 is a stitch 13 hanging between the two needle humps 10 and 11 of the double hook needle 1.

FIG. 2 shows a section through the tongue bar 4 in the needle hook 8 along the line II—II in FIG. 1. The needle hook 8 includes a recess 50 into which the tip 16 of the tongue bar 4 enters to begin the slide guiding of the tongue bar 4.

FIG. 3 is a section through the tongue bar 4 in the double hook needle 1 at the position of the needle hump 10. A recess 51 is provided in the needle hump 10 in which the end 52 of the tip 16 of the tongue bar 4 is received. The end 52 is completely covered by the needle hump 10 so that when the needle hook 1 and the push bar 2 move to the right the stitch can slide onto the tongue bar 4 without difficulty.

FIG. 4 shows a section through the tongue bar 7 and the stitch transfer bar 6 along the line IV—IV in FIG. 1. The tongue bar 7 is guided in the slit-like needle channel 53 of the stitch transfer bar 6. A rivet 54 extends laterally through the stitch transfer bar 6 and through a long hole 55 (FIG. 1) of the tongue bar 7. The rivet 54 and the long hole 55 guarantee proper positioning and guiding of the tongue bar 7 and the stitch transfer bar 6 relative to each other.

In FIG. 5 is shown a section through the tongue bar 7 and the stitch transfer bar 6 along the line V—V in FIG. 1. The section passes through the foot 56 of the tongue bar 7 which is widened relative to the longitudinal portion of the tongue bar 7 to the width of the stitch transfer bar 6. The stitch transfer bar 6 and the foot 56 are guided independently of each other in a needle bed channel 57.

Figure 6:
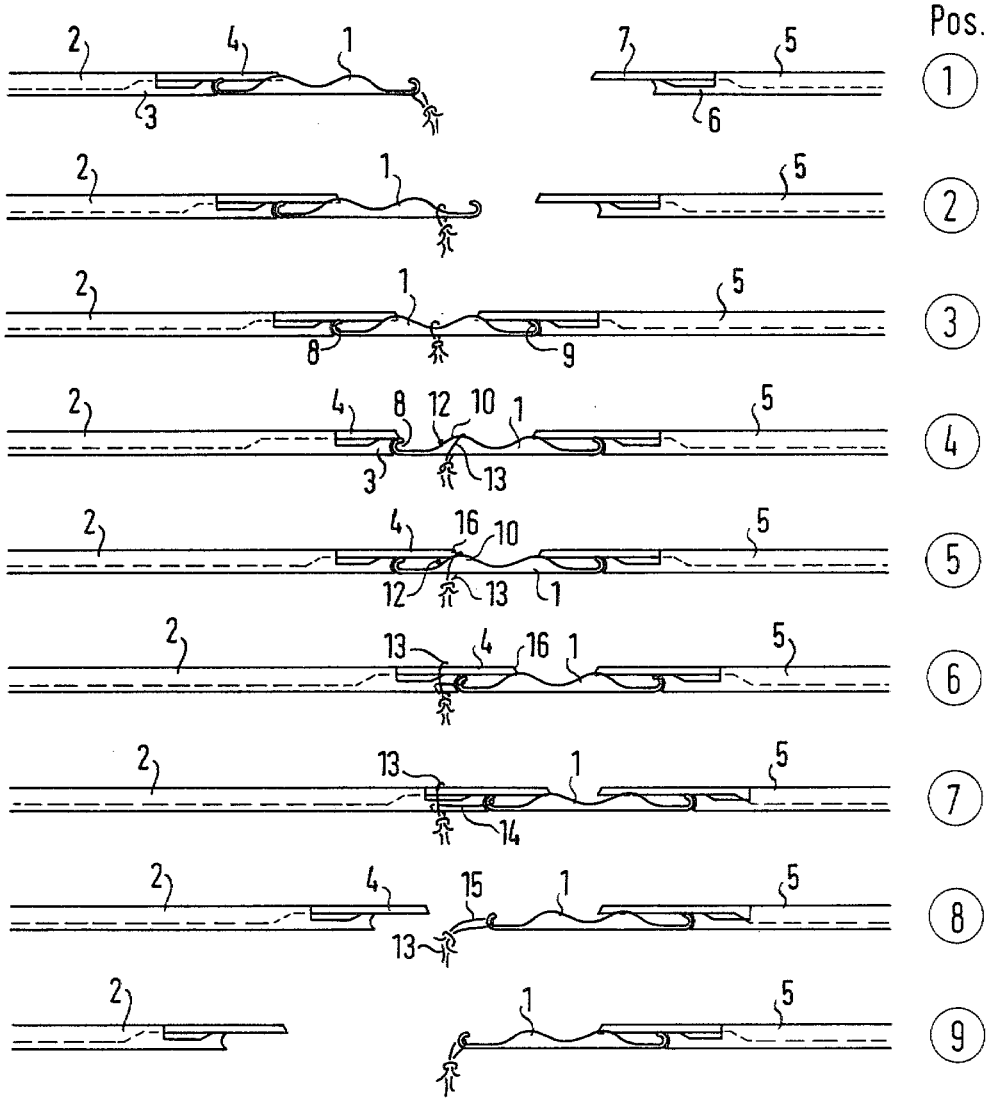
FIG. 6 is a schematic representation of the needle and push bar movements during the exchange of the needle from the forward to the rear needle bed in the formation of a stitch on the rear needle bed.

FIG. 6 illustrates the nine successive positions of the double hook needle, the stitch transfer bars and the tongue bars during left-left knitting and exchange of the double hook needle from the forward to the rear needle bed and stitch forming in the rear needle bed. The push bar 2 consisting of stitch transfer bar 3 and tongue bar 4 is located in the forward needle bed, and the push bar 5 consisting of stitch transfer bar 6 and tongue bar 7 is found in the rear needle bed.

Figure 7:
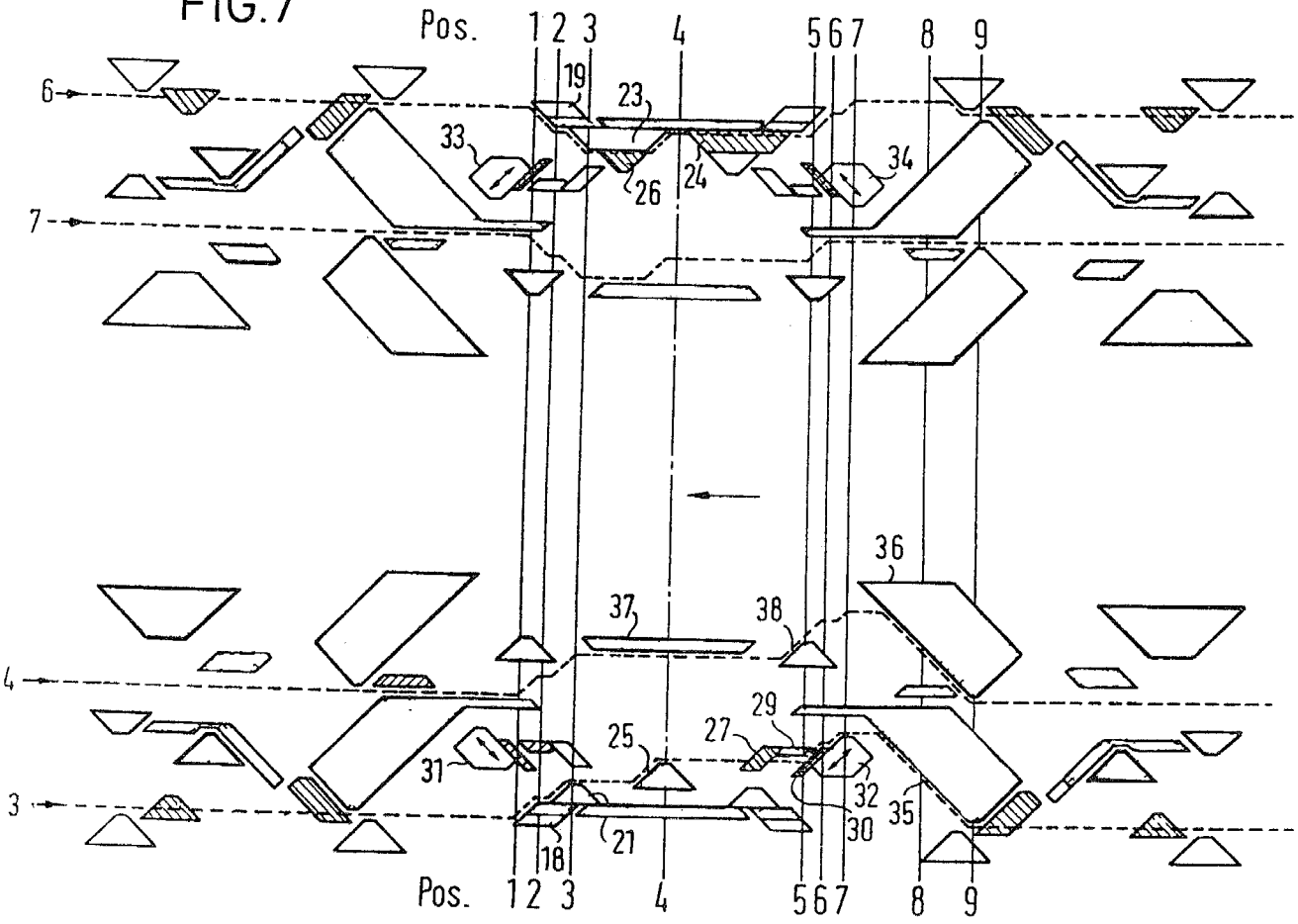
FIG. 7 is a schematic representation of the camming assembly for the operational process according to FIG. 6.

FIG. 7 illustrates the associated cam arrangement indicating the positions according to FIG. 6. The upper portion of the cam arrangement contains the cam elements for the rear needle bed to activate the stitch transfer bar 6 and the tongue bar 7 and the lower portion contains the cam elements for the forward needle bed to activate the stitch transfer bar 3 and the tongue bar 4. The movements of the stitch transfer bars and tongue bars are indicated by broken lines and are designated with the corresponding reference numerals.

The method of operation in left-left knitting is explained in greater detail below with the example of the movement of the double hook needle 1 from the forward to the rear needle bed, with reference to FIG. 6, positions 1 through 9.

Position 1 shows the double hook needle 1 and the push bar 2 in the forward needle bed, below designated as forward push bar 2, which consists of the forward stitch transfer bar 3 and the forward tongue bar 4, in the base position in the forward needle bed. Also shown is the push bar 5 in the rear needle bed, designated below as rear push bar 5, which consists of the rear stitch transfer bar 6 and the rear tongue bar 7, in the base position in the rear needle bed.

In position 2 the double hook needle 1 together with the push bars 2 and 5 is moved into catch position.

In position 3 the double hook needle 1 and the two push bars 2 and 5 are brought into the engagement or central position, i.e. the position where the needle is moved to form a stitch. Until this point is reached the forward and rear push bars 2 and 5 are moved toward each other until the ends 58 of the stitch transfer bars 3 and 6 come into abutment with the left and right needle hooks 8 and 9, respectively, thereby fixing the double hook needle 1 in both directions of movement.

In the movement into position 4 the forward tongue bar 4 remains in position 3, while the forward stitch transfer bar 3 pushes the double hook needle 1 further to the right, until the left needle hook 8 is opened and a new thread 12 can be laid out. The old stitch 13 is carried to the right by the left needle hump 10.

In position 5 only the forward tongue bar 4 moves to the right until the tip 16 thereof is threaded into the groove-like recess 51 (FIG. 3) of the left needle hump 10, arrives in front of the old stitch 13 and encloses the laid out thread 12.

In order to arrive in position 6, the forward and rear push bars 2 and 5 together with the double hook needle 1 move further to the right into the rear needle bed. The old stitch 13 thereby slides over the tip 16 onto the forward tongue bar 4. The size of the new stitch to be formed is determined during the further movement of the double hook needle 1 and the combined push bars 2 and 5 into position 7. During this movement the thread 12 is formed into a loop 14 of the selected size.

The reach position 8, the total forward push bar 2 first moves back until the old stitch 13 slides down from the forward tongue bar 4, hangs in the loop 14 and forms it into a new stitch 15.

Position 9 is then the base position of the combined push bars 2 and 5 as shown in position 1, except that the double hook needle 1 is now in the rear needle bed.

The cam arrangement for the knitting process according to FIG. 6 is shown in FIG. 7. With carriage movement in the direction of the arrow drawn in FIG. 7 from the right to the left, cam elements 18 and 19 bring the forward and rear combined push bars 2 and 5 as well as the double hook needle 1 out of the base position according to position 1 into the base position according to position 2 of FIG. 6. After a short pause the slide bars 2 and 5 are pushed into position 3 by cam elements 21 and 23. A cam element 25 then further extends the forward stitch transfer bar 3. Accordingly, the double hook needle 1 and the rear push bar 5 are moved further back while the forward tongue bar 4 is held in its position by a cam element 37. Cam elements 24, 26 and 27 are not active.

For further movement from position 4 into position 5 the forward stitch transfer bar 3, the double hook needle 1 and the rear combined push bar 5 maintain their positions, while the forward tongue bar 4 is moved backward by a cam element 38. A cam element 29 prevents a carrying of the forward stitch transfer bar 3. In a transistion from position 5 to position 6 all knitting tools, i.e. the combined push bars 2 and 5 and the double hook needle 1 are brought into the withdrawal area by a cam element 30, from where they are brought into the final withdrawal position according to FIG. 7 with the aid of a needle lowering element 32. For operation in the other carriage direction and in the other needle exchange direction further needle lowering elements 31, 33 and 34 are provided in addition to the needle lowering element 32.

From position 7 the forward stitch transfer bar 3 and the forward tongue bar 4 are pushed through position 8 into the base position according to position 9 with the aid of withdrawal elements 35 and 36.

Figure 8:
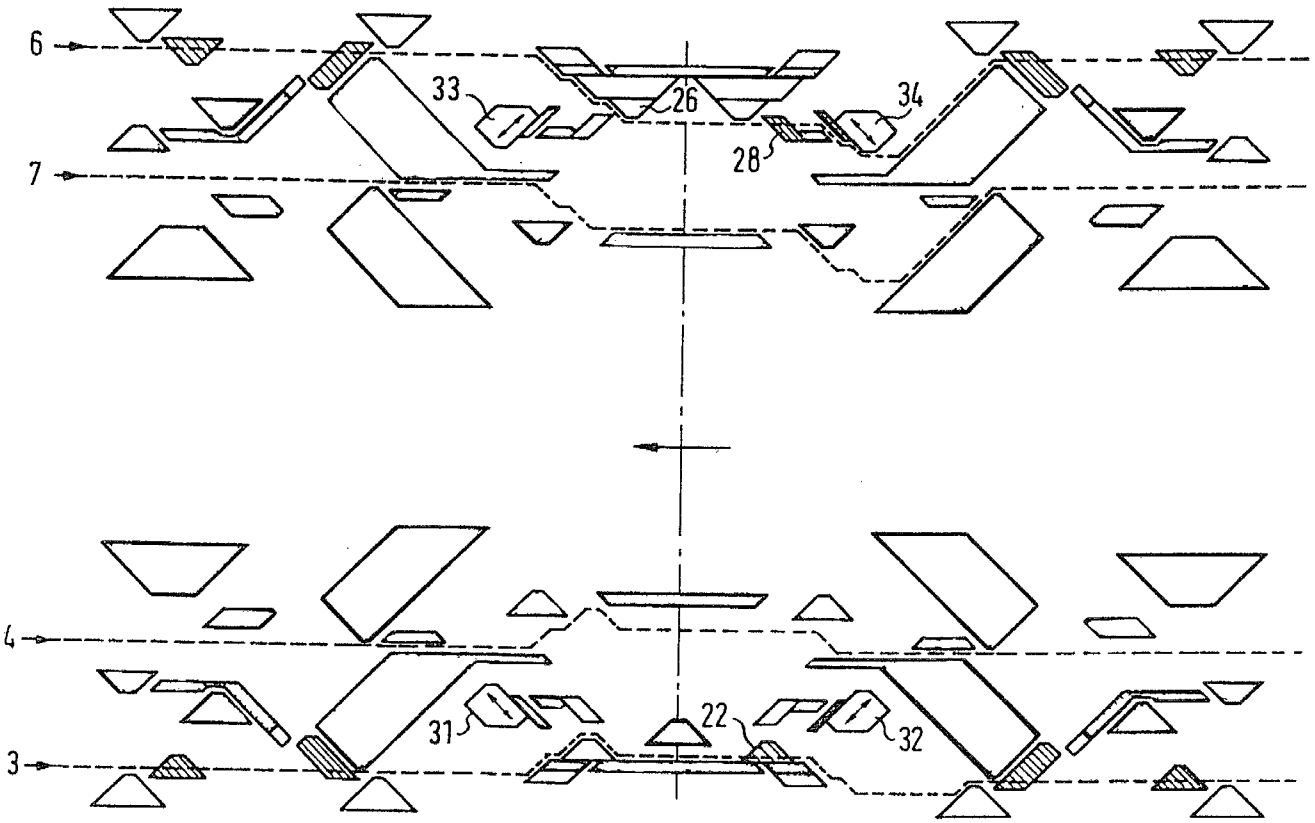
FIG. 8 is a schematic representation of the cam arrangement for an exchange of the needle from the rear needle bed into the forward needle bed and the formation of a stitch on the forward needle bed.

FIG. 8 shows a cam arrangement for a carriage movement from right to left according to the indicated arrow with an exchange of the double hook needle 1 from the rear to the forward needle bed with subsequent stitch formation in the forward needle bed. During this process cam elements 22 and 28 are inactive. The knitting tools are extended to position 3 and from there into a position which is a mirror image of position 4 in FIG. 6 by a cam element 26. All further movements continue according to FIG. 6 except that they are mirror images thereof.

Figure 9:
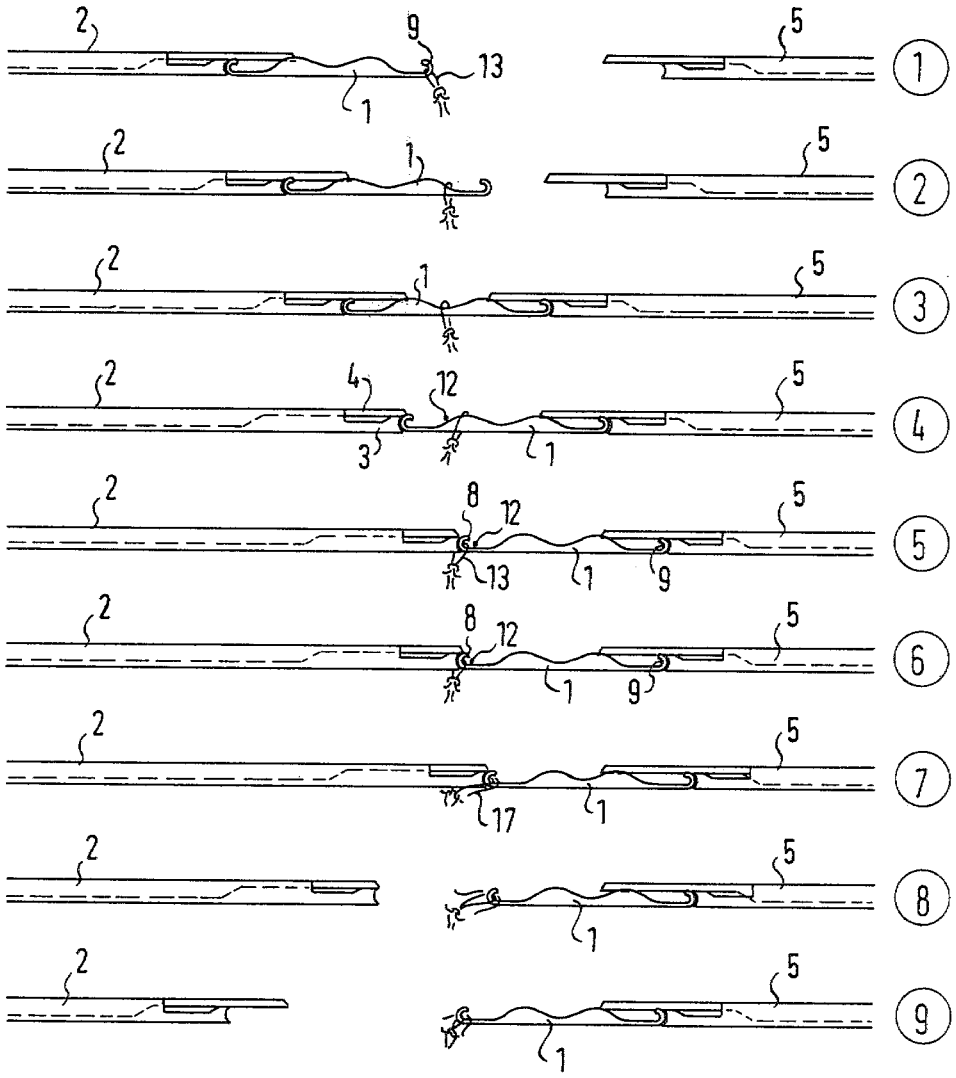
FIG. 9 is a schematic representation of the needle and push bar movements during a needle exchange from the forward to the rear needle bed and the formation of a loop on the rear needle bed.
Figure 10:
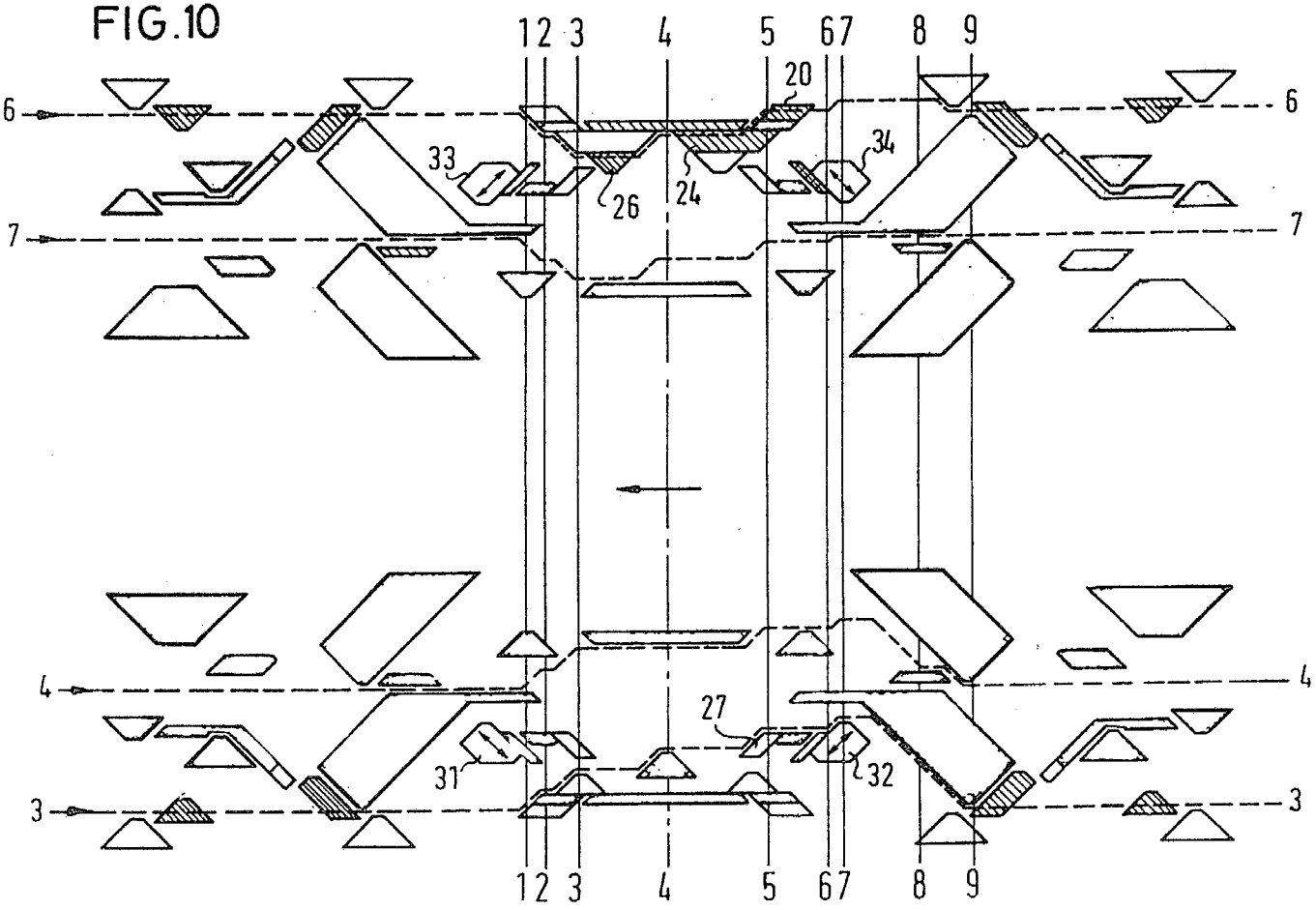
FIG. 10 is a schematic representation of the camming arrangement for the operational process according to FIG. 9.

FIG. 9 shows 9 positions during a needle exchange from the forward to the rear needle bed with catch loop knitting on the rear needle bed. The associated cam arrangement is shown in FIG. 10. The structure of FIGS. 9 and 10 corresponds to FIGS. 6 and 7. With carriage movement from right to left, cam elements 20, 24 and 26 in FIG. 10 are inactive. Until position 4 of FIGS. 9 and 10 is reached, the knitting tools perform the same movements as illustrated in stitch formation according to FIGS. 6 and 7. The position of the forward stitch transfer bar 3 to the forward tongue bar 4, as shown in position 4 of FIG. 9, must be maintained until position 7 is reached. This is accomplished by cam element 27. This cam element 27 brings the stitch transfer bar 3 and the tongue bar 4 into position 5 without them changing position relative to each other. The newly laid out thread 12 and the old stitch 13 slide into the open left needle hooks 8 in position 5. From position 5 to position 6 there is no change. Position 7 shows how the newly laid out thread 12 is formed into a catch loop 17. This type of knitting cannot be achieved with a double head tongue needle. The positions 8 and 9 are achieved in the same manner as described in connection with positions 8 and 9 according to FIGS. 6 and 7.

If during the knitting process according to FIG. 9, position 4, no new thread is laid out, then stitch 13 moves from the right needle hook 9 into the left needle hook 8 and the double hook needle 1 travels from the forward to the rear needle bed without having knitted. This is also not possible with known double head tongue needles without additional auxiliary means and additional movements.

A further distinction of the described flat knitting machine to known left-left flat knitting machines consists in the fact that the stitch forming needle lowering elements 31, 32, 33 and 34 (FIGS. 6, 8 and 10) operate oppositely. The needle lowering elements provided in the forward portion of the cam arrangement form the stitches or loops in the rear needle bed and the needle lowering elements provided in the rear portion of the cam arrangement form the stitches or loops in the forward needle bed. Furthermore, any desired thread knot combinations, stitches, catch loops and non-knitting can be achieved by means of proper selection processes, for example high and low foot bars, jacquard cards or through electronic controls.

Four stitch transfer bars are provided on the carriage of the flat knitting machine to the left and right and outside of the knitting cams. By means of these stitch transfer bars, the stitches can be transferred to the right or left adjacent needle. In so doing it makes no difference whether the stitches are located in the forward or rear needle bed and whether the carriage moves to the right or left, because the cams are arranged completely symmetrically.

Figure 11:
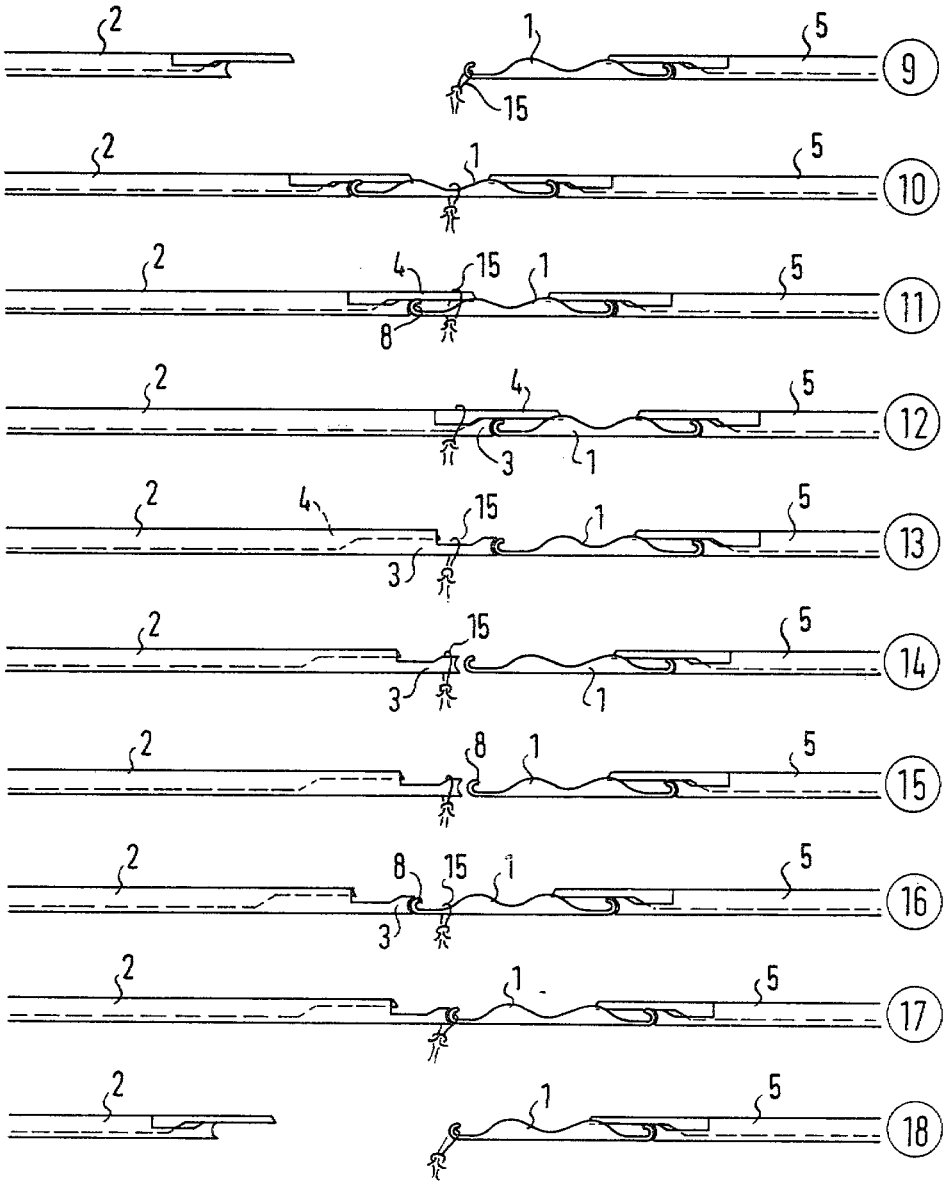
FIG. 11 is a schematic representation of the needle and push bar movements during the stitch transfer step during subsequent takeover of the stitches by the stitch transfer bars of the forward needle bed and preceeding takeover of the stitches by the needles in the rear needle bed.
Figure 12:
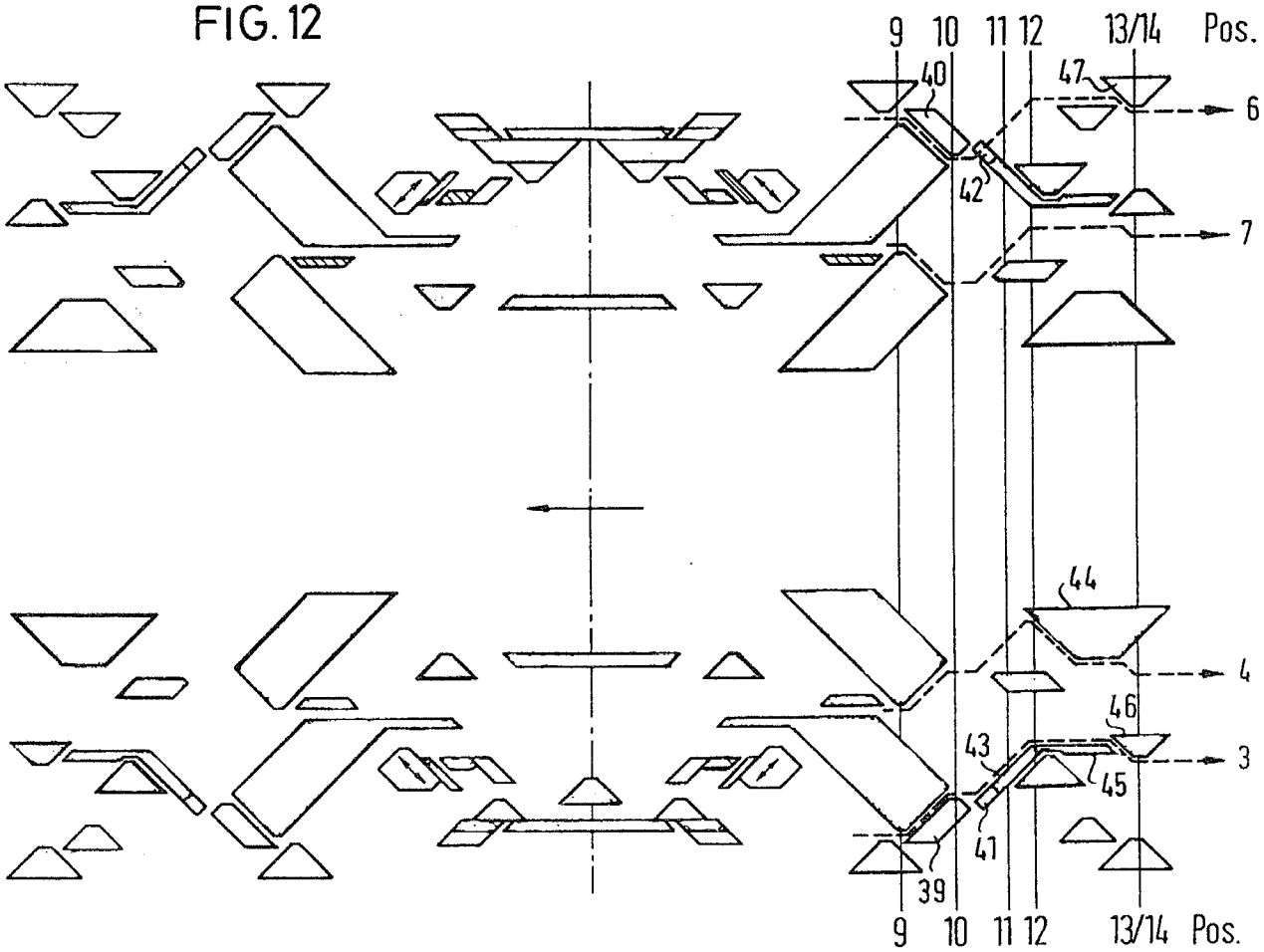
FIG. 12 is a camming arrangement for the subsequent takeover of the stitches by the stitch transfer bars of the forward needle bed according to FIG. 11.
Figure 13:
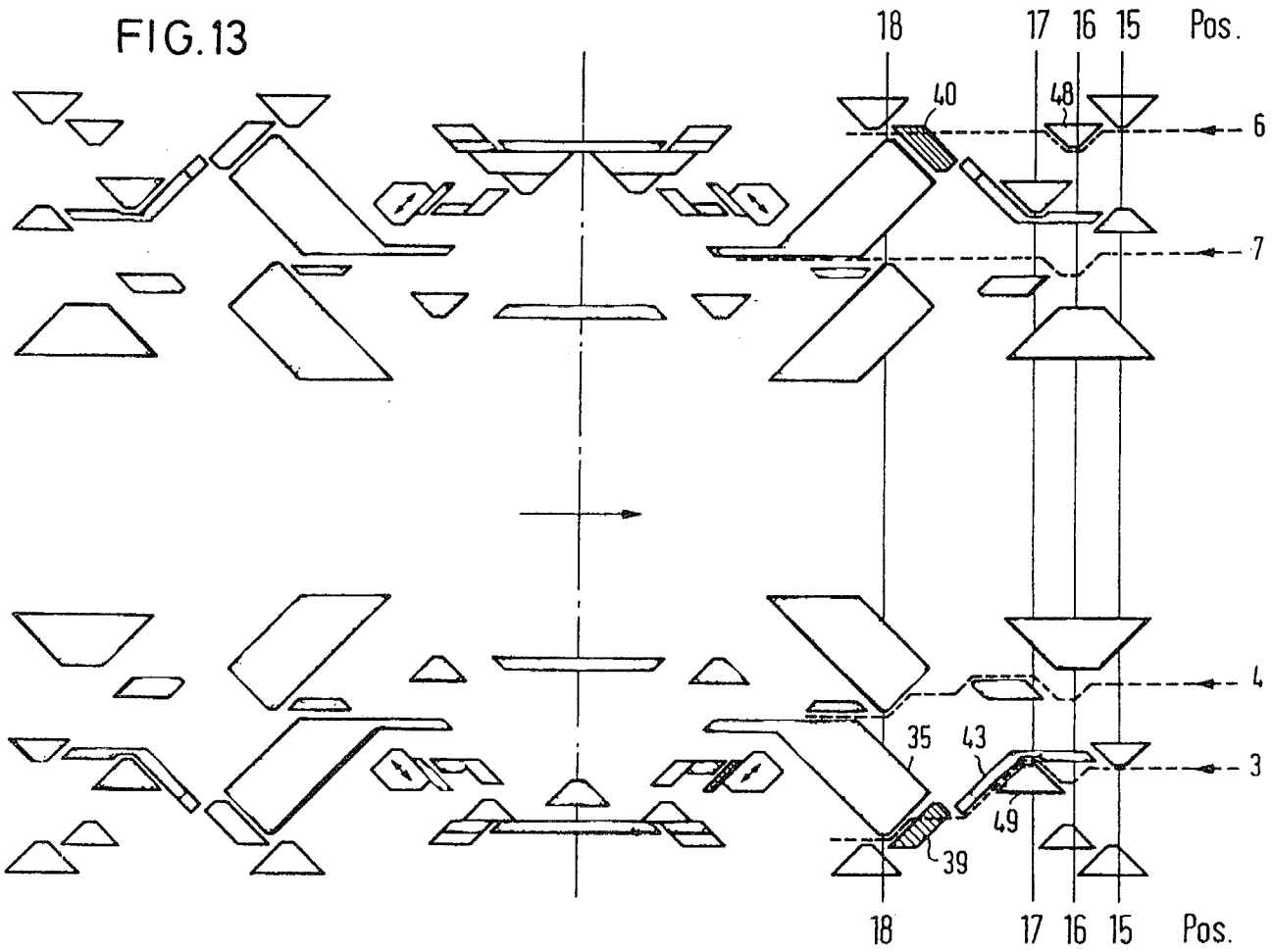
FIG. 13 is a camming arrangement for the preceeding takeover of the stitches by the needles in the rear needle bed according to FIG. 11.

FIG. 11 shows different positions of the double hook needle 1 and push bars 2 and 5, and namely for subsequent take over of the stitches by the forward stitch transfer bar 3 according to positions 9 through 14 in FIGS. 11 and 12 as well as for preceeding take over of the stitches by the double hook needles 1 in the rear needle bed according to positions 15 through 18 in FIG. 11 and FIG. 13. Between the subsequent and the preceeding take overs, and during the carriage reversal the forward or rear needle bed is displaced.

FIG. 11 schematically illustrates the stitch transfer process. After knitting, the knitting tools go into the base position corresponding to position 9 in FIG. 11, whereby the double hook needle 1 may be, for example, in the rear needle bed as shown.

As illustrated in FIG. 12, the cam elements 39 and 40 move the knitting tools into position 10 in FIG. 11, which corresponds to position 3 in the previously described knitting sequence. The forward cam element 41 is active and a rear cam element 42 is inactive. Cam element 41 drives the stitch transfer bar 3 and the tongue bar 4 toward the rear needle bed into position 11. The forward tongue bar 4, which holds the left needle hook closed, thereby takes over stitch 15.

During the course of further extension the knitting tools are pushed by a cam element 43 toward the rear needle bed until position 12 is reached. In this position the forward portion of the forward stitch transfer bar 3 is in the rear needle bed. The forward tongue bar 4 is then withdrawn from a cam element 44 until the stitch 15 slides away therefrom and hangs on the stitch transfer bar 3 as shown in position 13. During this movement a cam element 45 prevents the forward stitch transfer bar 3 from retracting. During the movement from position 13 to position 14 the combined forward push bar 2 is withdrawn by a cam element 46 until the forward stitch transfer bar 3 slides out of the rear needle bed area without dropping stitch 15. The entire rear push bar 5 is pushed into its basic position as shown by a cam element 47.

After reaching position 14 the carriage leaves the needle and travels to the left reversal point. During reversal the forward or rear needle bed is displaced to the right or left so that the forward stitch transfer bar 3 with its taken-over stitch lies opposite the neighboring needles of the rear needle bed.

After reversal of the carriage and during movement of the carriage from left to right according to the arrow in FIG. 13, the cam elements 39 and 40 are inactive, as shown in FIG. 13. Position 15 in FIG. 11 illustrates the starting position for the further stitch transfer process. Position 15 is the same as position 14.

The entire rear push bar and the double hook needle 1 are then pushed to the forward needle bed by a cam element 48. In so doing the left needle hook 8 abuts the forward stitch transfer bar 3 and pushes it also into the forward needle bed until the stitch 15 slides past and over the left needle hook 8 onto the double hook needle 1. This is illustrated in position 16.

A cam element 49 then pushes the entire forward push bar 2 toward the rear needle bed until the double hook needle 1 and the rear push bar 5 are in their base position in the rear needle bed, as illustrated in position 17. Thereupon the forward push bar 2 is drawn with the aid of cam elements 35 and 43 back to the bas position 18 where the position of the double hook needle 1 and the push bar 5 is unchanged relative to position 17.

The selection of needles takes place as with knitting cams either by high and low foot bars, jacquard cards or electronically.

Figure 14:
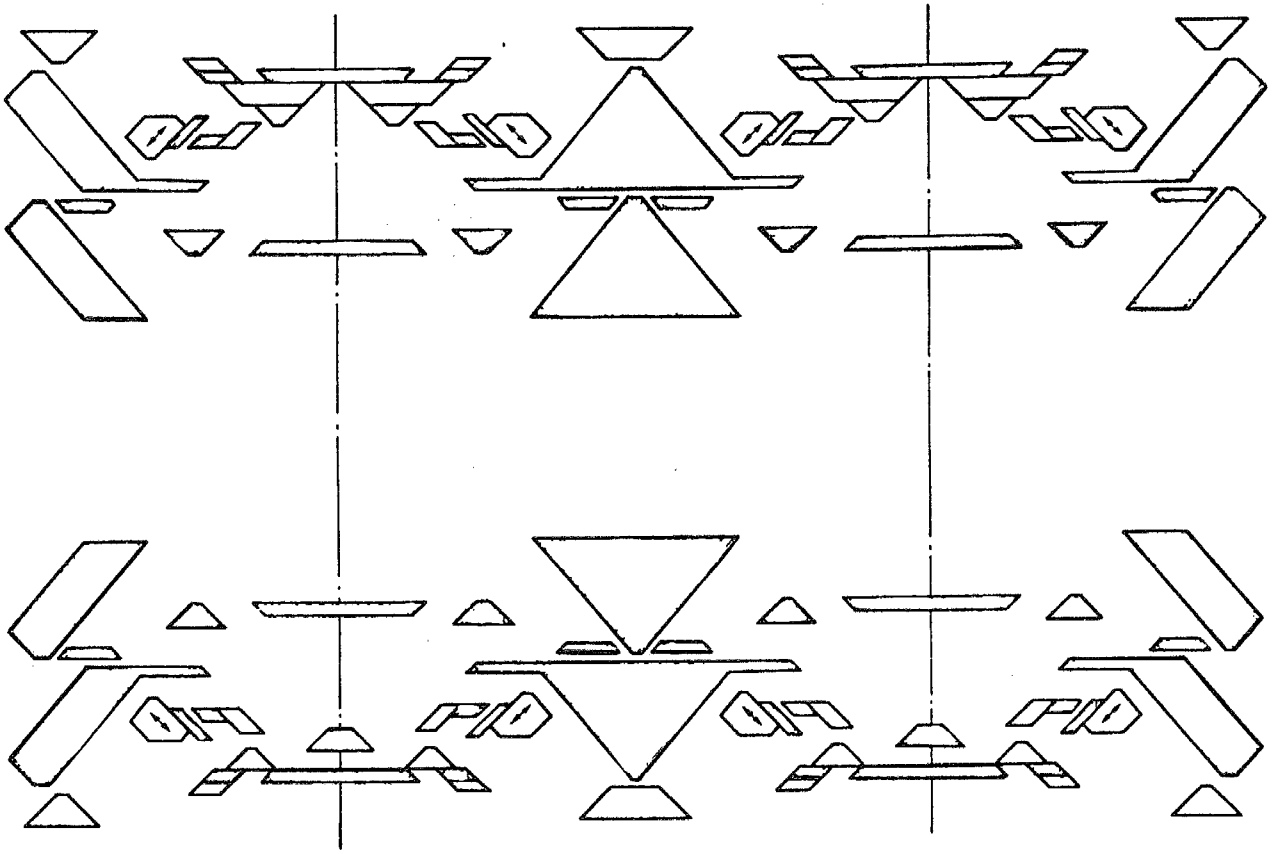
FIG. 14 is a camming arrangement of the left-left double cam for double hook needles having push bars without stitch transfer cams for a high performance left-left machine.

FIG. 14 illustrates a cam arrangement for a left-left double cam of a machine with double hook needles and push bars, but without stitch transfer cams. This cam arrangement is provided for a high performance left-left flat knitting machine and is clearly understandable from the illustration in FIG. 14 without further explanation.

Figure 15:
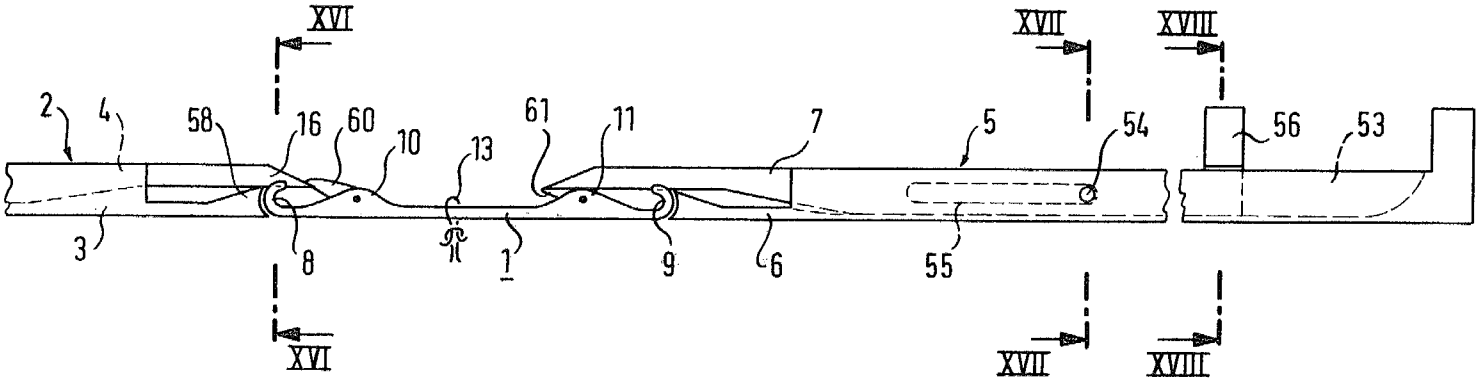
FIG. 15 is a side view of a further exemplary embodiment of a double hook needle having short control tongues together with push bars with closed and open needle hooks.

The further exemplary embodiment of a double hook needle 1 illustrated in FIG. 15 is in contact on the left side with a push bar 2 which is slidable in the forward needle bed (not shown) of a left-left flat knitting machine and with a push bar 5 which is slidable in the rear needle bed (not shown) of the machine and is reciprocated between these two needle beds by these push bars 2 and 5. The double hook needle 1 is symmetric with a left needle hook 8 and a right needle hook 9 as well as a left needle hump 10 and a right needle hump 11. The push bars 2 and 5 have identical structure.

The push bars 2 and 5 are formed respectively of stitch transfer bars 3 or 6 and tongue bars 4 or 7 which are slidable in the stitch transfer bars 3 or 6. The illustration of the right push bar 5 also shows a slit-like channel 53 in the stitch transfer bar 6 for receiving the tongue bar 7.

Short control bars 60, 61 are pivotably arranged on the left needle hump 10 and right needle hump 11, respectively. The control tongues 60 and 61 are unable to close the needle hooks 8 and 9 and do not form closed needle heads.

In its position pivoted toward needle hook 8, control tongue 60 lies above a tip 16 of the associated tongue bar 4. In its position pivoted toward the center of the needle, control tongue 61 lies flush with the crown of the needle hump 11 and is covered by tongue bar 7. The same positions hold true for the other control tongues.

FIG. 15 also shows a stitch 13 hanging between the two needle humps 10 and 11 of the double hook needle 1.

Figure 16:
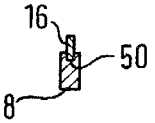
FIG. 16 is a cross section through the tongue bar and needle along the line XVI—XVI in FIG. 15.

FIG. 16 is a section through tongue bar 4 and the needle hook 8 along line XVI—XVI in FIG. 15. The needle hook 8 includes a recess 50 in which the tip 16 of tongue bar 4 lies and thereby slidably guides the tongue bar 4.

Figure 17:
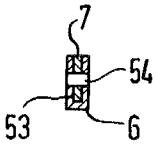
FIG. 17 is a cross section through the tongue bar and stitch transfer bar along the line XVII—XVII in FIG. 15.

FIG. 17 is a section through tongue bar 7 and the stitch transfer bar 6 along line XVII—XVII in FIG. 15. The tongue bar 7 is guided in the slit-like needle channel 53 of the stitch transfer bar 6. A rivet 54 passes laterally through the stitch transfer bar 6 and through a long hole 55 (FIG. 15) of the tongue bar 7. The rivet 54 and the long hole 55 assure reliable positioning and guiding of the tongue bar 7 and the stitch transfer bar 6 relative to each other.

Figure 18:
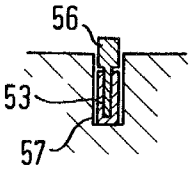
FIG. 18 is a cross section through the tongue bar and stitch transfer bar along the line XVIII—XVIII in FIG. 15.

FIG. 18 is a section through tongue bar 7 and the stitch transfer bar 6 along line XVIII—XVIII in FIG. 5. The section passes through the foot 56 of the tongue bar 7 which is expanded relative to the longitudinal portion of tongue bar 7 to the width of the stitch transfer bar 6. The stitch transfer bar 6 and the foot 56 are guided independently of each other in a needle bed channel 57.

Figure 19:
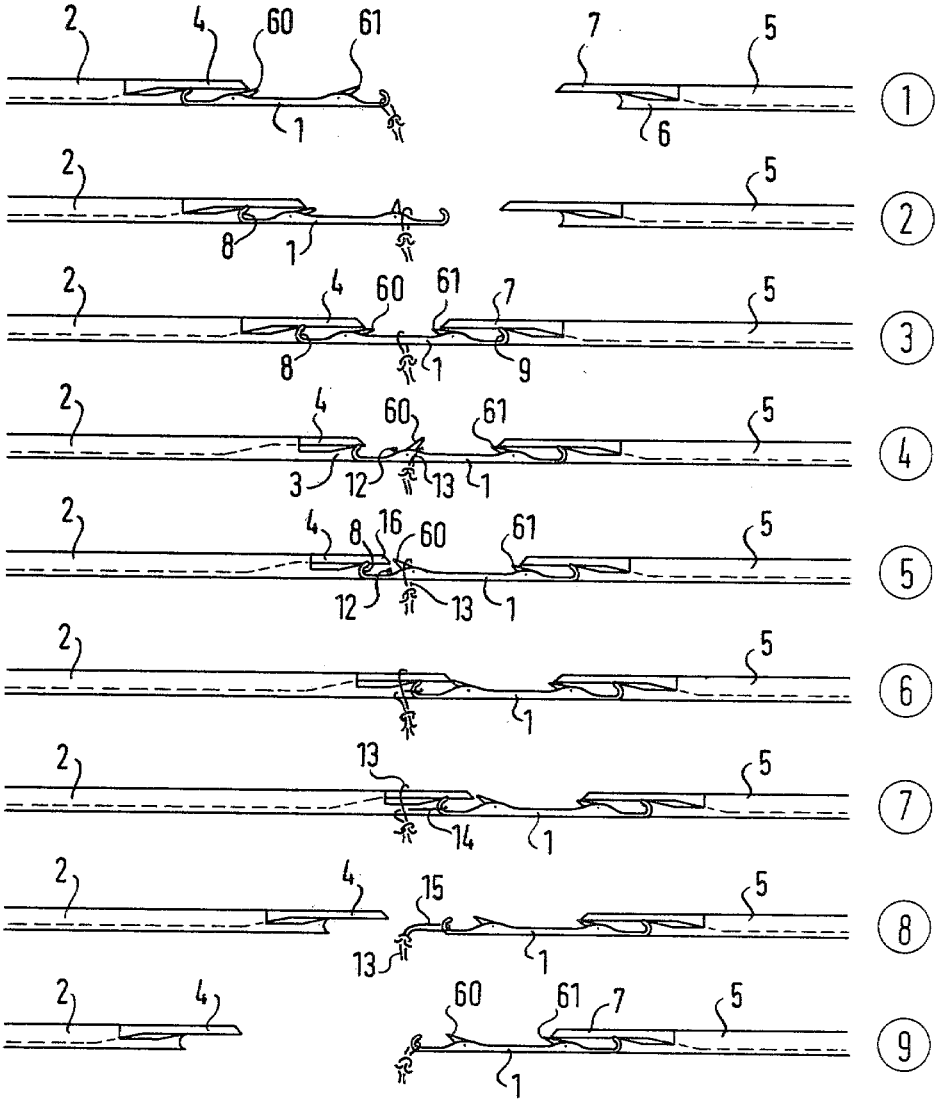
FIG. 19 is a schematic representation of the needle and push bar movements for the double hook needle according to FIG. 15, for example during the exchange of the needle from the forward to the rear needle bed and the formation of a stitch on the rear needle bed similar to the representation in FIG. 6 for the first exemplary embodiment of the double hook needle.

FIG. 19 illustrates nine successive positions of a further exemplary embodiment of the double hook needle, the stitch transfer bar and the tongue bar in left-left knitting and the exchange of the double hook needle from the forward to the rear needle bed while forming a stitch in the rear needle bed similar to the series shown for the first exemplary embodiment of the double hook needle in FIG. 6. The push bar 2 consisting of stitch transfer bar 3 and tongue bar 4 is located in the forward needle bed, the push bar 5 consisting of stitch transfer bar 6 and tongue bar 7 is located in the rear needle bed.

The associated cam arrangement indicating the positions according to FIG. 19 is identical with that shown in FIG. 7. The upper portion of the cam arrangement contains the cam elements for the rear needle bed to activate the stitch transfer bar 6 with the tongue bar 7 and the lower portion contains the cam elements for the forward needle bed to activate the stitch transfer bar 3 and tongue bar 4. The movements of the stitch transfer bars and tongue bars are indicated by broken lines and are designated by corresponding reference numerals.

The method of operation in left-left knitting, namely the example of the further exemplary embodiment of the double hook needle 1 traveling from the forward to the rear needle bed, is described in greater detail below with reference to FIG. 19, positions 1 through 9.

Position 1 shows the double hook needle 1 and the push bar 2 in the forward needle bed, below designated as forward push bar 2, which consists of the forward stitch transfer bar 3 and the forward tongue bar 4, in the base position in the forward needle bed. The push bar 5 in the rear needle bed, below designated as rear push bar 5, consisting of the rear stitch transfer bar 6 and the rear tongue bar 7 is shown in its basic position in the rear needle bed.

In position 2 the double hook needle 1 and both push bars 2 and 5 are pushed into catch position.

In position 3 the double hook needle 1 and both push bars 2 and 5 are brought into enclosure or central position, i.e. in the position of the needle extension where stitches are formed. The control tongues 60 and 61 are opened by the tongue bars 4 and 7. Up until this point the forward and rear push bars 2 and 5 were moved together toward each other, until the ends 58 of the stitch transfer bars 3 and 6 came into abutment with the left and right needle hooks 8 and 9, respectively, thereby fixing the double hook needle 1 in both sliding directions.

During the movement into position 4, the forward tongue bar 4 remains in position 3 while the forward stitch transfer bar 3 pushes the double hook needle 1 further to the right until the left needle hook 8 is opened (the control tongue 60 also being open) and a new thread 12 can be laid out. The old stitch 13 is carried to the right by the left needle hump 10.

In position 5 only the forward tongue bar 4 moves to the right until its tip 16 passes under the control tongue 60 which is pivoted toward the needle hook 6 by the old stitch 13 and, together with the control tongue 60, encloses the laid out thread 12.

In order to arrive in position 6, the forward and rear combined push bars 2 and 5 together with the double hook needle 1 move to the right into the rear needle bed. The old stitch 13 thereby slides over the control tongue 60 and the tip 16 onto the forward tongue bar 4. During further movement of the double hook needle 1 and the combined push bars 2 and 5 into position 7 the size of the newly formed stitch is determined. In so doing the thread 12 is first formed into a loop 14 of the desired size.

In order to reach position 8, the entire forward push bar 2 first moves back until the old stitch 13 slides down from the forward tongue bar 4, hangs in the loop 14 and forms it into a new stitch 15.

Position 9 is then the base position of the combined push bars 2 and 5 as in position 1, but the double hook needle 1 now lies in the rear needle bed.

The operation of the individual cam elements is the same as described above in conjunction with FIG. 7.

What is claimed is:

1. A left-left flat knitting machine with two needle beds arranged in a common plane, knitting needles provided with needle hooks at both ends thereof, and bars provided in the needle bed channels of both needle beds to activate said knitting needles, characterized in that said knitting needles are formed as double hook needles without pivoted tongues for closing said hooks and (1) having two needle humps substantially the same height as said needle hooks (10,11) and that the bars are so formed as to act only as push bars (2,5), each composed of a stitch transfer bar (3,6) and a tongue bar (4,7) having integral feet.

2. Flat knitting machine according to claim 1, wherein a short control tongue (60,61) is hinged to each needle hump of each double hook needle, said tongues being shorter than the distance between said hooks and said humps.

3. Flat knitting machine according to claim 2, wherein a tip (16) of an associated tongue bar (4, 7) passes beneath said control tongue when said tongue is pivoted toward said needle hooks.

4. Flat knitting machine according to claim 2, wherein said control tongues, when pivoted towards the center of said needle, lie flush with the crown of their associated needle humps and are covered by their associated tongue bars (4, 7).

5. Flat knitting machine according to claim 1, wherein said tongue bars are formed with tips (16), ends (52) of which can be fully recieved in recesses (51) in their associated needle humps (10, 11) of said double hook needle 1.

6. Flat knitting machine according to claim 1, wherein said stitch transfer bars define channels (53) in which said tongue bars are guided.

7. Flat knitting machine according to claim 1, wherein said stitch transfer bars and tongue bars are slidably connected with each other by rivets (54) in said stitch transfer bars and long holes (55) in said tongue bars.

8. Flat knitting machine according to claim 1, wherein said needle hooks of said double hook needle define recesses (50) in which said tongue bars are guided.

9. Flat knitting machine according to claim 1, wherein said tongue bars (4, 7) are slidably disposed on projections (58) on the tips of said stitch transfer bars.

10. Flat knitting machine according to claim 1, wherein a foot (56) of said tongue bar is expanded relative to the longitudinal portion thereof to the width of said stitch transfer bar.

11. Flat knitting machine according to claim 10, wherein said needle beds define channels (57) in which said stitch transfer bars and said feet of said tongue bar are independently guided.

* * * * *